US011208772B2

(12) United States Patent
McDeid et al.

(10) Patent No.: US 11,208,772 B2
(45) Date of Patent: Dec. 28, 2021

(54) REDUCED VOLUME SONIC NOISE ALERT PATTERN GRINDER AND METHOD

(71) Applicant: Surface Preparation Technologies, LLC, Mechanicsburg, PA (US)

(72) Inventors: Andy McDeid, Rogers, MN (US); Al Adamek, Rogers, MN (US); Clint Peterson, Rogers, MN (US)

(73) Assignee: Surface Preparation Technologies, LLC, Mechanicsburg, PA (US)

( * ) Notice: Subject to any disclaimer, the term of this patent is extended or adjusted under 35 U.S.C. 154(b) by 0 days.

(21) Appl. No.: 16/228,138

(22) Filed: Dec. 20, 2018

(65) Prior Publication Data

US 2019/0382969 A1 Dec. 19, 2019

Related U.S. Application Data

(63) Continuation of application No. 15/411,525, filed on Jan. 20, 2017, now abandoned.

(60) Provisional application No. 62/281,624, filed on Jan. 21, 2016.

(51) Int. Cl.
*E01C 23/09* (2006.01)

(52) U.S. Cl.
CPC ..... *E01C 23/0993* (2013.01)

(58) Field of Classification Search
CPC ..... E01C 23/0993
See application file for complete search history.

(56) References Cited

U.S. PATENT DOCUMENTS

| | | | |
|---|---|---|---|
| 193,171 | A | 7/1877 | McRae |
| 894,269 | A | 7/1908 | Hendron |
| 995,974 | A | 6/1911 | Lewis |
| 1,791,668 | A | 2/1931 | Fox et al. |
| 2,244,742 | A | 6/1941 | Tyson |
| 2,502,043 | A | 3/1950 | Howard |
| 2,574,090 | A | 11/1951 | Dofsen |
| 2,791,442 | A | 5/1957 | Lee et al. |
| 2,826,128 | A | 3/1958 | Summers |
| 3,094,046 | A | 6/1963 | Zipelius |
| 3,104,600 | A | 9/1963 | White |

(Continued)

FOREIGN PATENT DOCUMENTS

| | | |
|---|---|---|
| DE | 2 209 743 | 9/1973 |
| DE | 32 00 862 | 7/1983 |

(Continued)

OTHER PUBLICATIONS

Affidavit of Glenn Shed, 2 pages (executed Feb. 27, 2002).

(Continued)

*Primary Examiner* — Janine M Kreck
*Assistant Examiner* — Michael A Goodwin
(74) *Attorney, Agent, or Firm* — Merchant & Gould, P.C.

(57) ABSTRACT

A pavement grinding apparatus moves along a direction of travel and includes a cutting assembly. The cutting assembly has a grinding carriage; the grinding carriage including a rotating arbor having cutting elements. A control wheel is in contact with the pavement and connected to the grinding carriage to impart a cyclical up and down movement to the grinding carriage. The control wheel includes equally spaced apart lobes on the periphery of the control wheel that move the arbor in a sinusoidal up and down pattern.

18 Claims, 10 Drawing Sheets

(56) References Cited

U.S. PATENT DOCUMENTS

| | | | | |
|---|---|---|---|---|
| 3,212,240 | A | 10/1965 | Streete | |
| 3,407,005 | A | 10/1968 | Simms et al. | |
| 3,529,517 | A | 9/1970 | Liddle et al. | |
| 3,572,842 | A | 3/1971 | Mori | |
| 3,605,579 | A | 9/1971 | Heltzel | |
| 3,612,611 | A | 10/1971 | Ellis | |
| 3,649,071 | A | 3/1972 | Graff | |
| 3,662,658 | A | 5/1972 | Berrange | |
| 3,702,093 | A | 11/1972 | Van de Loock et al. | |
| 3,767,264 | A | 10/1973 | Eckey | |
| 3,788,704 | A | 1/1974 | Staab | |
| 3,801,211 | A | 4/1974 | Perkins | |
| 3,868,146 | A | 2/1975 | Ellis | |
| 3,874,806 | A | 4/1975 | Grist et al. | |
| 3,901,553 | A | 8/1975 | Binger et al. | |
| 3,929,377 | A | 12/1975 | Weaver et al. | |
| 3,950,110 | A | 4/1976 | Clifford | |
| 4,067,398 | A | 1/1978 | Franzen et al. | |
| 4,147,448 | A | 4/1979 | Jeffery | |
| 4,174,184 | A | 11/1979 | Heenan | |
| 4,346,766 | A | 8/1982 | Manten | |
| 4,392,689 | A | 7/1983 | Moore et al. | |
| 4,422,795 | A | 12/1983 | Berrange | |
| 4,493,584 | A | 1/1985 | Guntert | |
| 4,516,808 | A | 5/1985 | Staab et al. | |
| 4,575,278 | A | 3/1986 | Whitney | |
| 4,623,277 | A | 11/1986 | Wayne et al. | |
| 4,701,069 | A | 10/1987 | Whitney | |
| 4,764,051 | A | 8/1988 | Whitney | |
| 4,792,190 | A | 12/1988 | Bertrand | |
| 4,878,713 | A | 11/1989 | Zanetis | |
| 4,885,012 | A | 12/1989 | Thompson | |
| 4,900,094 | A | 2/1990 | Sergeant | |
| 4,909,575 | A | 3/1990 | Lupton | |
| 4,986,604 | A | 1/1991 | Meister | |
| 5,078,540 | A | 1/1992 | Jakob et al. | |
| 5,083,839 | A | 1/1992 | Younger | |
| 5,092,658 | A | 3/1992 | Smith | |
| 5,094,565 | A | 3/1992 | Johnson | |
| 5,114,269 | A | 5/1992 | Shepherd | |
| 5,190,398 | A | 3/1993 | Swisher | |
| 5,192,160 | A | 3/1993 | Muehlstaedter | |
| 5,215,071 | A | 6/1993 | Mertes et al. | |
| 5,297,894 | A | 3/1994 | Yenick | |
| 5,354,146 | A | 10/1994 | O'Konek | |
| 5,391,017 | A | 2/1995 | Thomas et al. | |
| 5,415,495 | A | 5/1995 | Johnson | |
| 5,484,228 | A * | 1/1996 | Thomas | E01C 23/088 404/72 |
| 5,492,431 | A | 2/1996 | Rasmussen et al. | |
| 5,582,490 | A | 12/1996 | Murray | |
| 5,607,255 | A | 3/1997 | Thomas et al. | |
| 5,676,490 | A | 10/1997 | Nelson | |
| 5,857,453 | A | 1/1999 | Caven et al. | |
| 5,860,764 | A | 1/1999 | Roberts | |
| 6,004,076 | A | 12/1999 | Cook | |
| 6,116,599 | A | 9/2000 | Kaczmarski et al. | |
| 6,206,478 | B1 | 3/2001 | Uehara et al. | |
| 6,210,071 | B1 | 4/2001 | McSharry | |
| 6,220,783 | B1 | 4/2001 | Maxwell | |
| 6,364,419 | B1 | 4/2002 | Cannizzo et al. | |
| 6,379,081 | B1 | 4/2002 | Barbulescu | |
| 6,454,490 | B1 | 9/2002 | Murphy | |
| 6,499,809 | B1 | 12/2002 | O'Konek | |
| 6,505,995 | B2 | 1/2003 | Sanfilippo et al. | |
| 6,547,484 | B2 | 4/2003 | Murphy | |
| 6,565,282 | B1 | 5/2003 | Gray | |
| 6,612,773 | B2 | 9/2003 | Gray | |
| 6,755,482 | B2 | 6/2004 | Johnson | |
| 6,843,535 | B1 * | 1/2005 | Thomas | E01C 23/0993 299/39.1 |
| 6,843,615 | B1 | 1/2005 | Cook | |
| 7,029,072 | B1 * | 4/2006 | Murray | E01C 23/0993 299/39.4 |
| 7,029,370 | B2 | 4/2006 | Cochran et al. | |
| 7,073,975 | B2 | 7/2006 | Kraemer | |
| 7,168,886 | B2 * | 1/2007 | Loader | E01C 19/235 404/106 |
| 7,325,881 | B2 | 2/2008 | Cochran et al. | |
| RE40,505 | E | 9/2008 | Murphy | |
| 7,625,152 | B2 | 12/2009 | Swamidass | |
| 7,731,448 | B2 | 6/2010 | Fillie | |
| 7,798,158 | B2 | 9/2010 | Crocker | |
| 7,837,276 | B2 | 11/2010 | Kraemer et al. | |
| 8,025,342 | B2 | 9/2011 | Kraemer et al. | |
| 8,491,219 | B2 | 7/2013 | Abresch et al. | |
| 8,821,063 | B2 | 9/2014 | Johnson et al. | |
| D727,975 | S | 4/2015 | Brockway | |
| D727,976 | S | 4/2015 | Brockway | |
| 9,574,310 | B2 | 2/2017 | Johnson et al. | |
| 2002/0176746 | A1 | 11/2002 | Murphy | |
| 2002/0192025 | A1 * | 12/2002 | Johnson | E01C 23/088 404/75 |
| 2004/0005190 | A1 * | 1/2004 | Jakits | E01C 23/0993 404/75 |
| 2015/0086268 | A1 * | 3/2015 | Johnson | E01C 23/0993 404/72 |
| 2016/0053446 | A1 | 2/2016 | Killion | |

FOREIGN PATENT DOCUMENTS

| | | |
|---|---|---|
| EP | 0 283 286 | 9/1988 |
| EP | 0 298 682 | 1/1989 |

OTHER PUBLICATIONS

Statement of Jeff Arnswald, 2 pages (executed Mar. 5, 2002).

"Devices to Prevent Run-Off-Road Accidents", California State Department of Transportation, Sacramento Transportation Lab, U.S. Department of Commerce, National Technical Information Service, 61 pages (Feb. 1976).

International Grooving and Grinding Association brochure entitled, "Grooved Runways are Safer . . . Ground Runways are Easier on Aircraft", 8 pages (Apr. 1989).

International Grooving and Grinding Association brochure entitled, "Grooving & Grinding are Cost Effective Ways to Restore Pavement Surfaces", 4 pages (prior art at least as early as Jul. 16, 1998).

Target RTM PRM 3804 brochure, 2 pages (prior art at least as early as Jul. 16, 1998).

Target Safetrac Systems Rebuilding America's Infrasu ucture flyer, 2 pages (prior art at least as early as Jul. 16, 1998).

Cushion Cut PC-5000 Highway Grinder brochure, 4 pages (prior art at least as early as Jul. 16, 1998).

* cited by examiner

REDUCED VOLUME SONIC NOISE ALERT PATTERN GRINDER AND METHOD

BACKGROUND

1. Field of the Invention

The present invention is directed to an apparatus for forming a sonic noise alert pattern (SNAP) in the surface of the road, and in particular, to a high speed grinder for forming a series of spaced apart sinusoidal depressions in pavement.

2. Prior Art

Rumble strips or sonic noise alert pattern (SNAP) depressions in the surface of the road are well known and widely referred to as rumble strips. Such depressions generate an easily heard noise when a vehicle tire drives over such a stretch of pavement. In addition, vibration is usually passed to the driver and passengers of the vehicle, alerting them that they have passed over such a pattern of depressions. Such SNAP depressions are often placed at the side of the road on the shoulder or along the centerline of two lane roads to alert a driver that the vehicle has veered off the driving lane, as may happen when drivers fall asleep at the wheel. In addition, rumble strips are placed across the width of the lanes of the road to alert the driver that he/she is approaching a stop or reduced speed limit and to slow down in anticipation of the upcoming reduced speed or stop.

It can be appreciated that forming such depressions in the road typically requires a grinding device that must rise and fall in a predetermined cycle to create a series of substantially evenly spaced apart depressions. For very hard pavement surfaces, such as concrete surfaces, the power required is substantial in order to form the depressions. The speed of forming such depressions is generally quite slow, on the order of a several hundred feet per minute. When miles of such SNAP depressions must be formed in the road, the work can be a very time consuming process. In addition to the time required, the costs become substantial for a crew and the grinding equipment. Besides the costs of forming the strips, the inconvenience to drivers using the road, including lane closures, can be substantial, causing severe traffic delays.

A known device for forming such strips is shown in U.S. Pat. No. 6,499,809. This patent shows a device and method for making SNAP depressions in the surface of pavement. The pavement grinder has a grinding arbor supported on transverse parallel shafts with an offset to produce an up and down reciprocal motion to raise and lower the grinding carriage and form depressions in the pavement.

Another device for cutting depressions in the road is shown in U.S. Pat. No. 5,297,894, to Yenick. The Yenick patent shows a pivotally mounted cutting head with a pair of guide wheels and a cam at the rear of the cutting device to raise and lower the cutting head. The cam includes a chain arrangement to raise and lower the cutting head to the proper depth. However, the pivoting arrangement does not provide sufficient power or speed for the cutting head for some applications. The Yenick device requires the cutting head to follow a cam member with a wheel engaging the outer periphery of the cam.

Although rumble strips have proven effective at alerting drivers when their vehicles is drifting from the driving lane, the noise generated may be too loud and may be a nuisance to those close to the rumble strips. In some cases, rumble strips have been filled in to deal with the excessive noise. However, this eliminates the safety benefits provided by the rumble strips. Much of the noise is due to the wheel entering and leaving each depression as typical depressions do not have a gradual transition to and from the road surface.

In an effort to provide a satisfactory warning to drivers while producing less noise than conventional rumble strips, warning strips that still produce a vibration at a lower noise volume have been developed. Such quieter patterns, referred to as mumble strips, may be placed in the same locations as conventional rumble strips and produce a vibration and noise, but are quieter when vehicles pass over the patterns. To produce less noise, the mumble strips are formed by recesses with a more gradual entry and exit transition for each recess. The pattern of recesses therefore takes on a continuous sinusoidal pattern. Such a pattern eliminates sharp edges that may be formed at the entry into and exit from each recess, resulting in a quieter pattern, but still providing sufficient warning to drivers. It can be appreciated that grinding such a pattern requires a gradual engagement and disengagement of the grinding head rather than a plunge cut and may be difficult to obtain.

It can be seen then, that a new and improved method and apparatus for cutting evenly spaced apart sinusoidal depressions in the surface of pavement to form a sonic noise alert pattern is needed. Such a grinding device should provide for directly lowering and raising the cutting head in a continuous repeating pattern with a gradual entry and exit to and from each recess. A grinder should have a simple and reliable construction that provides sufficient power and direct support for raising and lowering the cutting head in a predetermined pattern at sufficient speed to cut even hard pavement material at speeds of over one mile per hour. The present invention addresses these as well as other problems associated with cutting a series of sonic noise alert pattern depressions in the surface of the pavement.

SUMMARY OF THE INVENTION

The present invention relates to an apparatus and method for forming rumble strips, also known as Sonic Noise Alert Pattern (SNAP) depressions in the surface of the road. In particular the present invention relates to an apparatus and method for quieter reduced volume rumble strips, sometimes referred to as mumble strips.

The grinding apparatus includes a truck chassis that supports a grinding carriage on its own movable frame. The grinding carriage has a cutting assembly that can be moved between a raised travel position and a lowered cutting position. The cutting assembly includes an arbor which includes carbide teeth mounted along and around the arbor. The width of depressions ground in the pavement is variable depending on the number and arrangement of the teeth mounted on the arbor. The arbor mounts to the grinding carriage of the cutting assembly. The grinding carriage includes motors and a drive train to drive the arbor and may include belts, chains or may have motors directly mounted to the arbor shaft. The cutting assembly may also include a cooling system typically providing cooling water for the arbor to prevent the cutting teeth from overheating and to control dust. The grinding carriage has a control wheel that is coupled to the arbor to control up and down motion of the arbor.

The grinding carriage mounts to the rear of a chassis, such as a truck chassis, on a support assembly that provides for adjusting the lateral position of the grinding carriage relative to the chassis. With such adjustment the chassis can be driven in a safe and efficient position on a road that minimizes traffic disruption, keeps the pavement grinder in a safe path of travel, allows the driver to view the grinding carriage operate and keeps the arbor cutting a pattern at the correct location on the pavement.

The control wheel is a non-round wheel formed by a tire mounted on a rim. The tire is a solid element and made of compound having minimal to low compression even when subjected to the forces associated with pavement grinding. The periphery of the tire is non-round and the diameter varies in an undulating repeated pattern. The pattern is sinusoidal and wraps around the periphery of the tire. In one embodiment, the tire forms three lobes of maximum diameter. The lobes alternate with three depressions of minimum diameter. The areas between the lobes and the depressions gradually transition in the sinusoidal pattern. In the embodiment shown, the diameter varies one quarter inch, between twelve and three-quarter inches at the depressions and thirteen inches at the maximum height of the lobes. The distance between adjacent depressions, which is also the distance between the peaks of the lobes, is fourteen and one-half inches. As the depressions and the lobes are evenly spaced about the periphery of the tire, the distance between any two lobes and the distance between any two depressions is the same fourteen and one-half inches.

In use the control wheel controls the up and down movement of the cutting assembly and the depth with which the arbor grinds. The control wheel has a non-circular outer periphery with increasing and decreasing diameter around the wheel in an evenly spaced pattern. The control wheel has lobes of increased diameter alternates with three depressions of decreased diameter. The outer periphery gradually transitions from the depressions to the lobes. The gradual increase and decrease follows a sinusoidal pattern extending around the periphery of the control wheel. The varying diameter causes the center axis, and therefore the axle, of the control wheel to rise and fall. The control wheel axle rises relative to the ground when one of lobes is in contact with the ground surface while the axle lowers when one of the depressions engages the ground. The height of the axis of rotation rises and falls as the control wheel contact point transitions between the maximum at the apex of the lobes and the trough at the bottom of the depressions.

The cutting assembly is coupled to the control wheel so that the elevation of the arbor rises and falls with the height of the axle of the control wheel. The arbor also rises and falls in a sinusoidal pattern matching the pattern on the control wheel. The rising and falling causes the arbor to grind a sinusoidal pattern in the pavement.

In operation, when one of the lobes is engaging the ground, the arbor is raised. As the grinder advances and the control wheel rolls along the ground, the control wheel is supported on a portion of its periphery transitioning between the maximum diameter of a lobe and the bottom of a depression on the control wheel. At this position, the arbor is lowered slightly to grind at a shallow depth in the pavement. Further advancement of the grinder and rotation of the control wheel takes the cutting assembly to a position in which one of the depressions of the control wheel engages the ground and the grinding arbor descends to its greatest depth into the pavement. This forms the bottom of a depression in the pavement of a sonic noise alert pattern. As the grinder advances further and the control wheel continues to roll along the ground, the cutting assembly again attains an intermediate position between fully raised and fully lowered. Further advancement moves the control wheel and arbor to a configuration with the next lobe contacting the pavement and the arbor raised. As the grinder advances, the pattern repeats and an evenly spaced sinusoidal pattern is formed in the pavement. The transitions between the pavement surface and the bottom of a depression formed in the pavement are gradual and the sinusoidal pattern formed is quieter when driven over by vehicle tires as compared to conventional sonic noise alert patterns.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
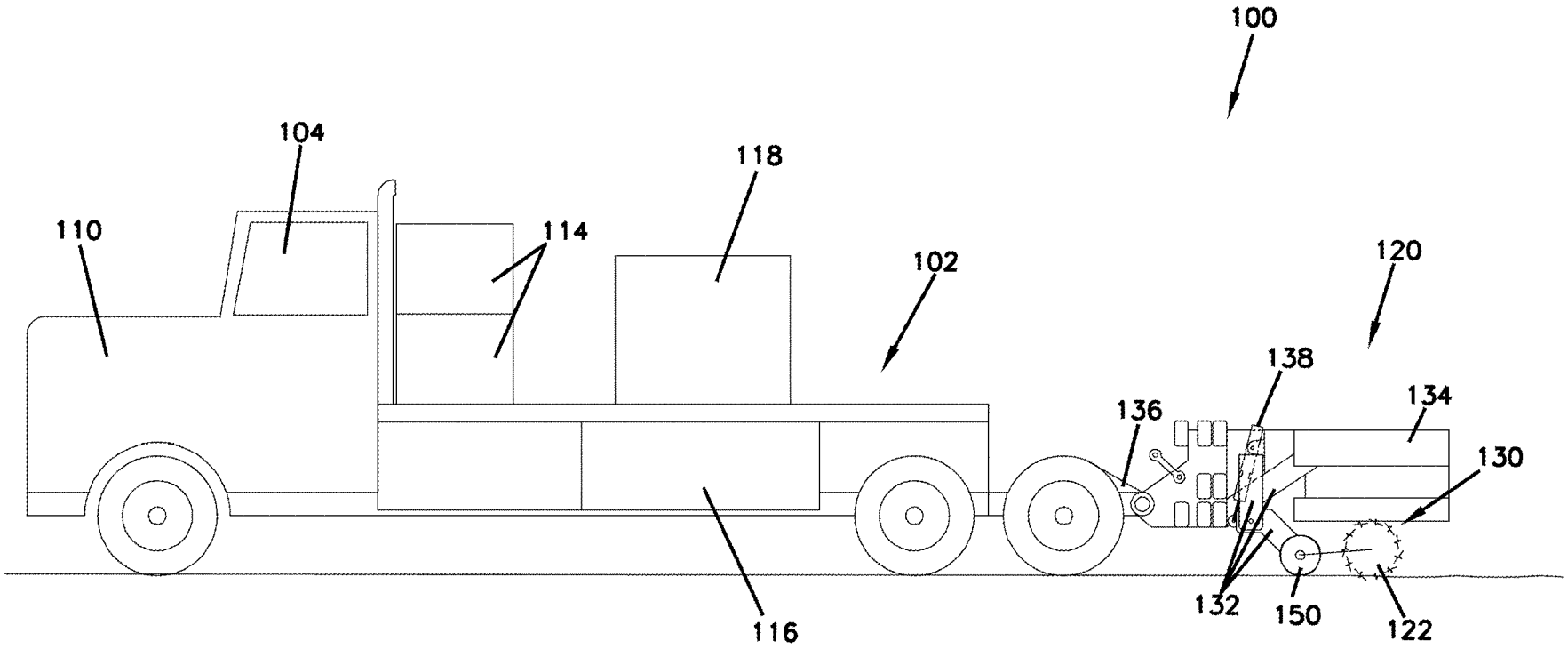
FIG. 1 is a side elevational view of a pavement grinder according to the principles of the present invention.
Figure 6:
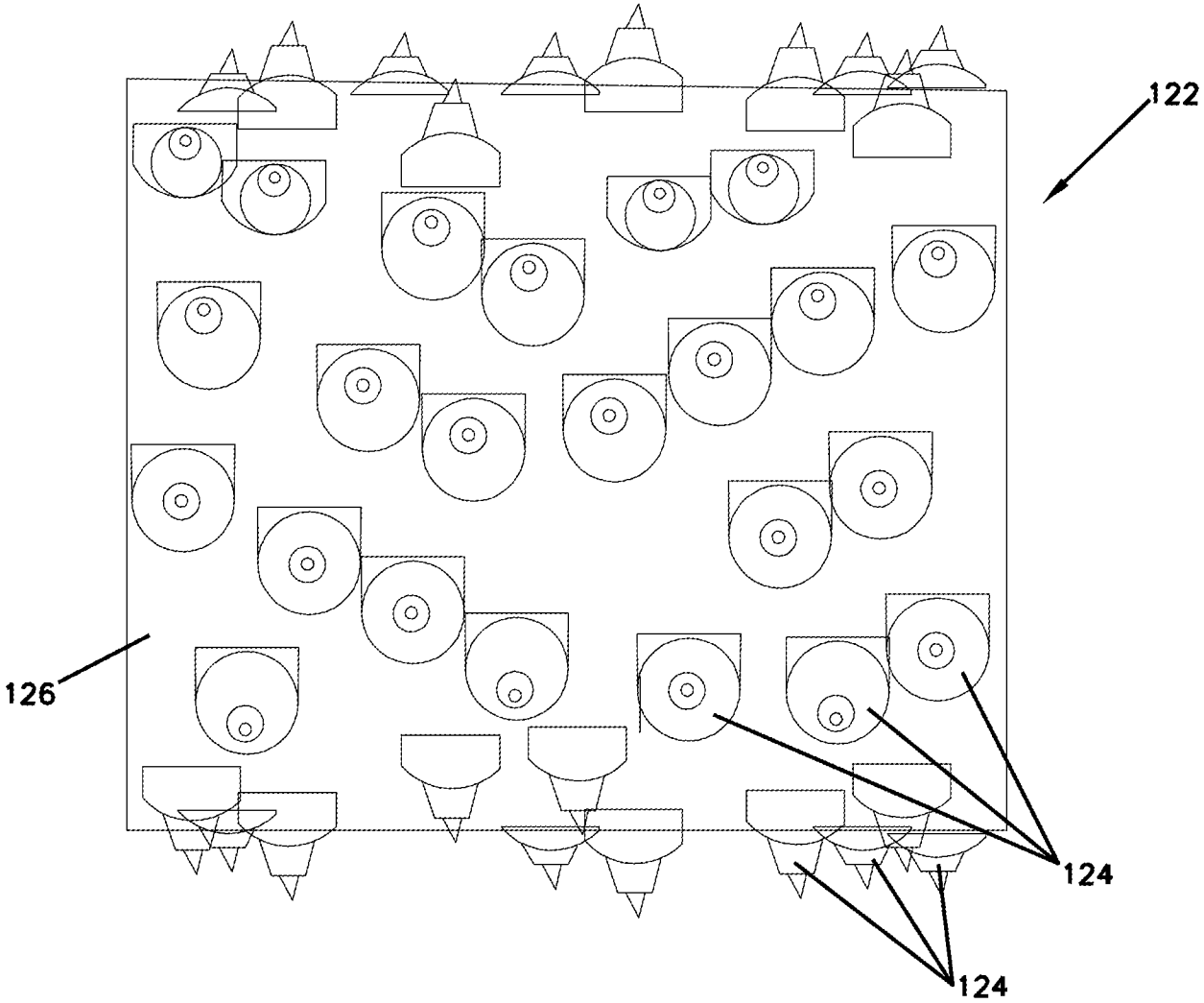
FIG. 6 is a top plan of a cutting head.

Referring to the drawings and in particular to FIG. 1, there is shown a pavement grinder, generally designated 100. The grinder 100 includes a truck chassis 102 supporting a cutting assembly 120 at the rear of the chassis 102. The cutting assembly 120 has a grinding carriage 130 with an arbor 122. As shown in FIG. 6, hardened carbide cutting teeth 124 mount in a side by side arrangement on an arbor axle 126. The truck chassis 102 includes a cab 104 for the driver providing an open field of vision for the driver. The cab 104 also has controls for the grinder, such as speed and grinding functions. The truck chassis 102 provides propulsion and is powered by an engine 110. An engine 118 mounted on the bed of the truck chassis 102 supplies power for hydraulic motors for the cutting assembly 120 and other systems of the cutting assembly 120. A water tank 116 supplies the water for cooling and dust control. Moreover, oil and fuel tanks 114 may be mounted on the truck chassis. Moreover, although shown mounted to the rear of a truck chassis 102 in FIG. 1, the present invention may be configured as a dedicated self-propelled grinder.

The cutting assembly 120 includes an arbor 122, shown in FIG. 6, which includes cutting elements 124, such as carbide cutting teeth, mounted along a cylinder 126 of the arbor 122. The width of depressions ground in the pavement is variable depending on the number of teeth 124 and their arrangement on the arbor 122. It can be appreciated that the teeth 124 may be mounted in groups or rows as may be best suited for the pavement material and the grinding conditions. The arbor 122 mounts to the grinding carriage 130 of the cutting assembly 120. The grinding carriage 130 includes a housing 134 containing motors and a drive train, such as a drive belt(s) or drive chain(s) to drive the arbor 122. The drive train may include belts, chains or motors directly mounted to the arbor shaft 126. The cutting assembly may also include a cooling system typically providing cooling water for the arbor 122 to prevent the teeth 124 from overheating. The grinding carriage 130 has a control wheel 150 that is coupled by a linkage 132 to the arbor 122 to control up and down motion of the arbor 122, as explained hereinafter. The height of the arbor 122 relative to the control wheel 150 can be changed by extending or retracting an adjustable profile cylinder 138. The profile cylinder adjusts the relative height of the arbor 122 and therefore the depth of the recesses being formed in the pavement.

Figure 2:
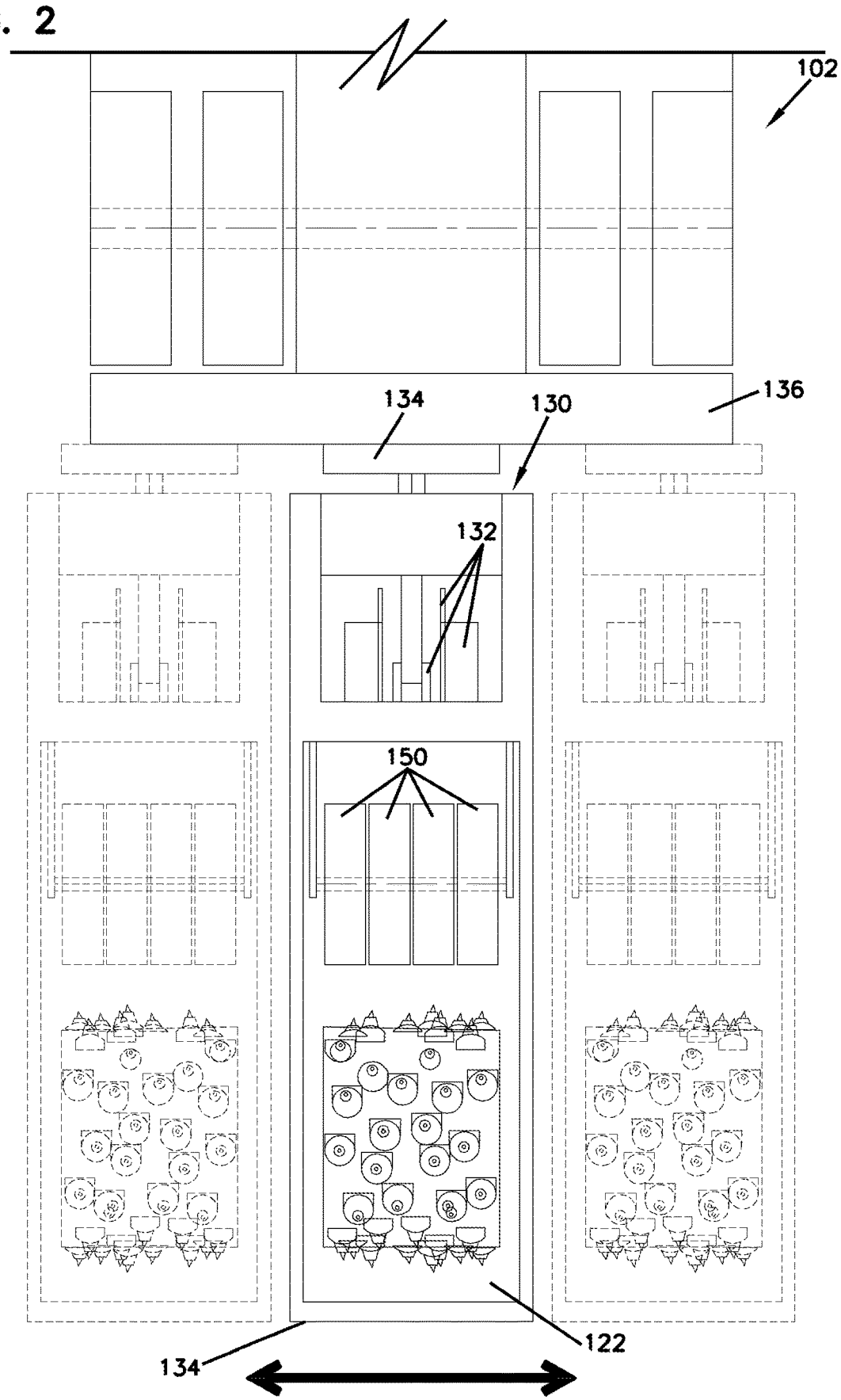
FIG. 2 is a bottom view of the rear of the truck chassis and cutting assembly with the laterally adjusted positions of the arbor shown in phantom.

The grinding carriage 130 is mounted to the rear of the chassis 102 on a support assembly 136. As shown in FIG. 2, the support assembly 136 provides for adjusting the lateral position of the grinding carriage 130 relative to the chassis 102. With such adjustment the chassis 102 can be driven in a position on a road that minimizes traffic disruption, keeps the pavement grinder 100 in a safe path of travel, allows the driver to view the grinding carriage 130 operate and keeps the arbor 122 cutting a pattern at the correct location on the pavement.

Figure 7:
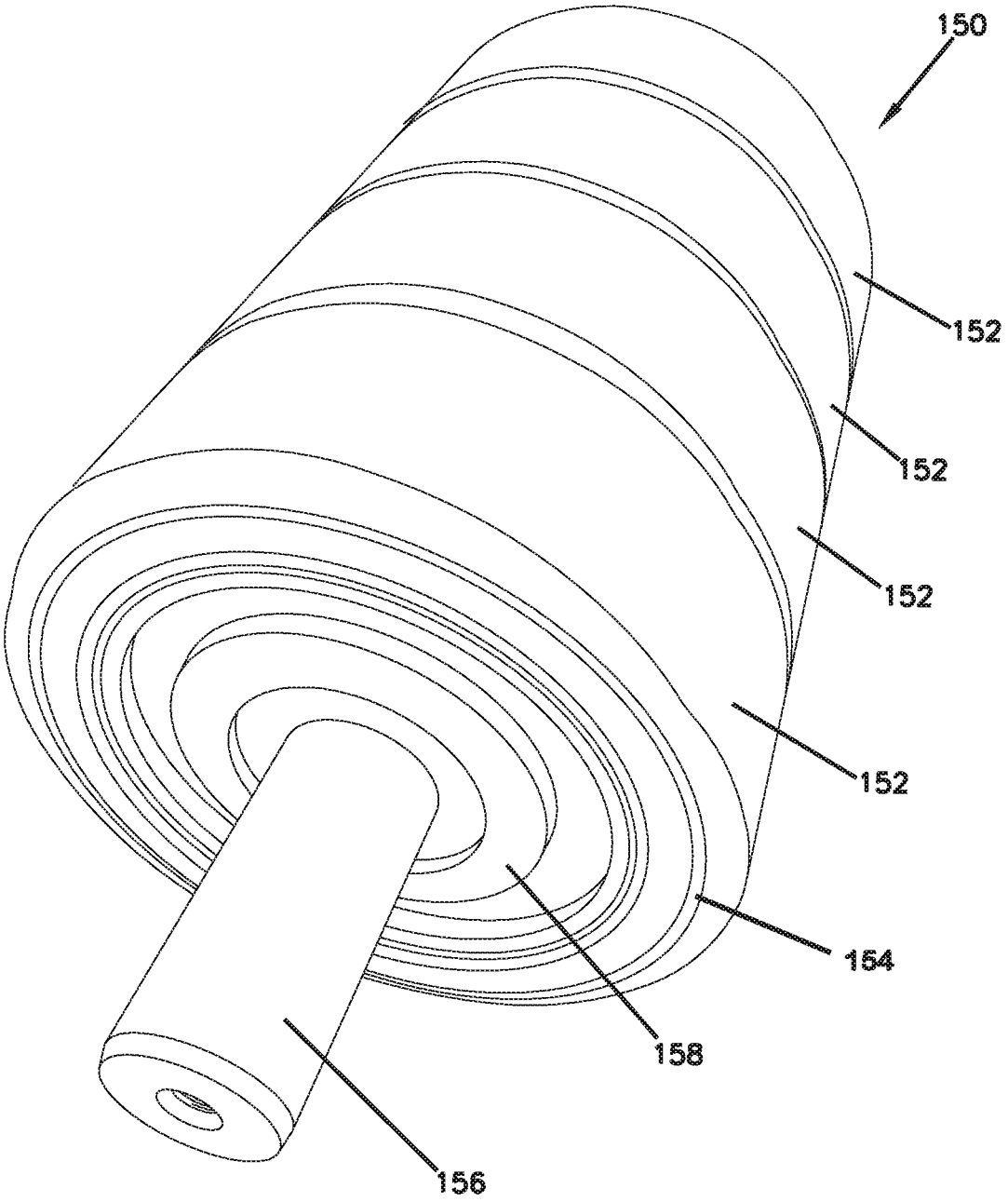
FIG. 7 is a perspective view of the control wheel assembly.
Figure 8:
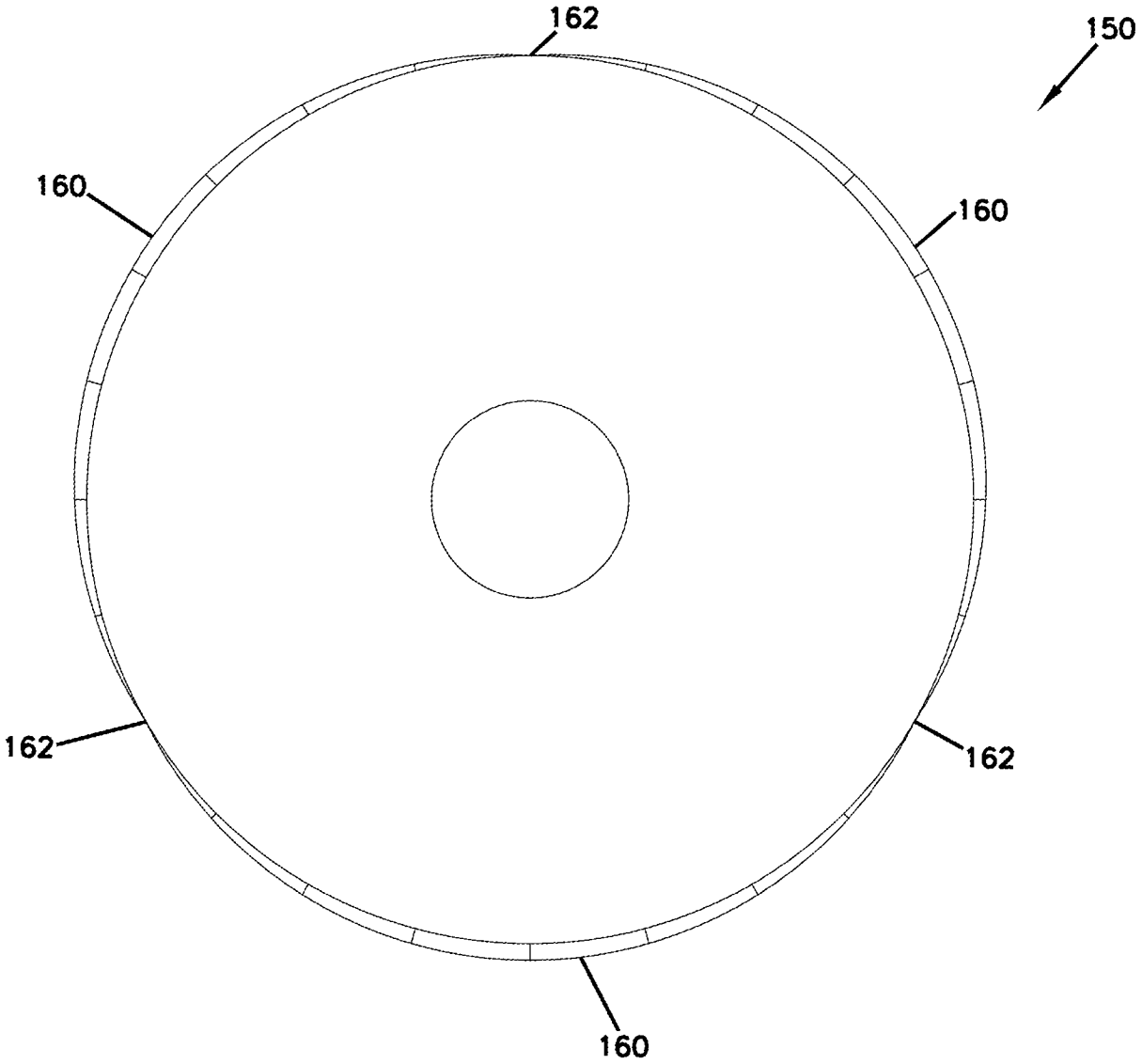
FIG. 8 is an end profile of the control wheel assembly.
Figure 9:
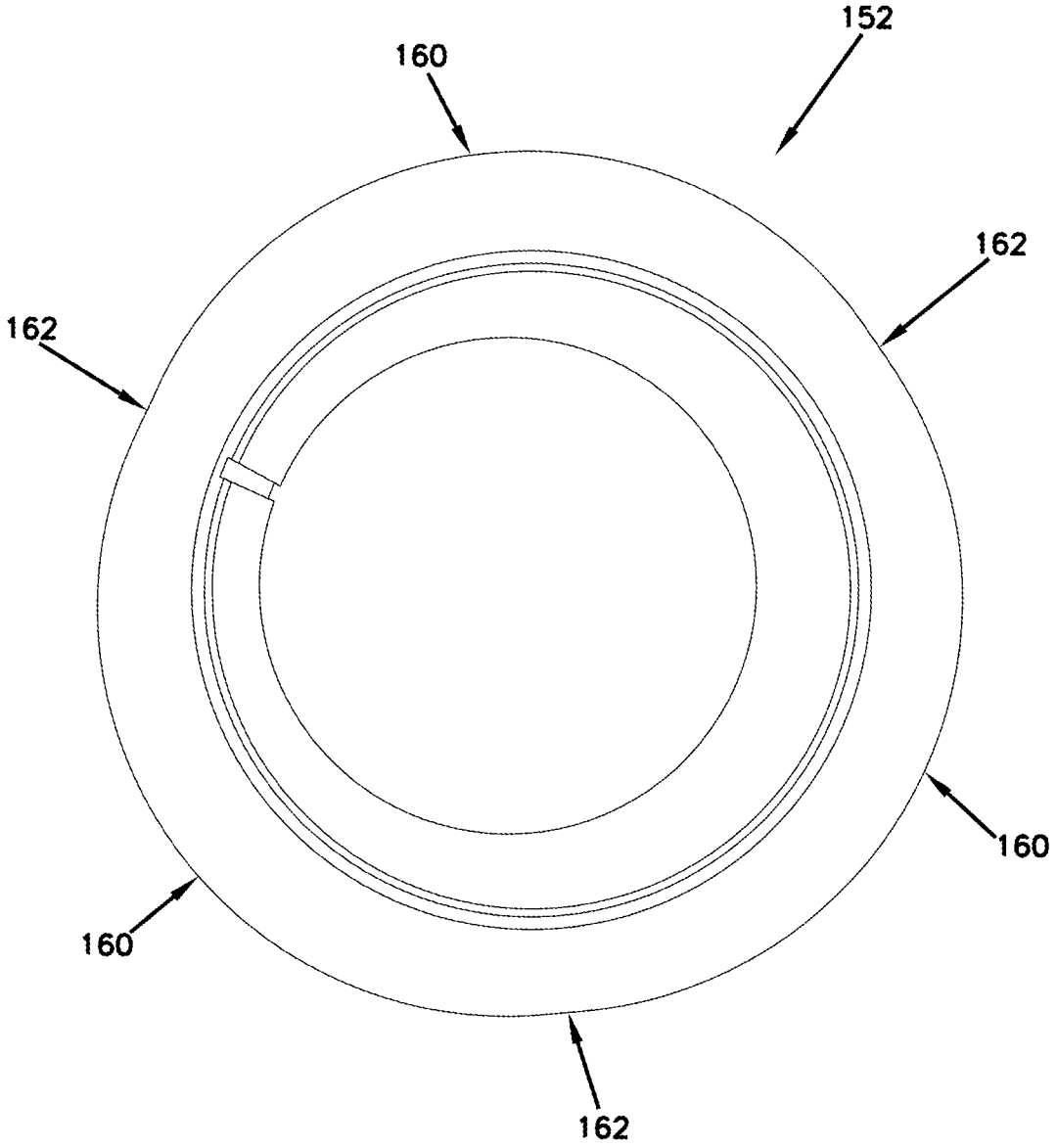
FIG. 9 is a side elevational view of a rim and tire for the control wheel assembly.

Referring to FIGS. 7-9 the control wheel 150 is configured as a non-round wheel. As shown in FIG. 7, the wheel 150 is formed of an outer tire 152 mounted on an inner rim 154. The tire 152 is a solid element and made of a hard compound having minimal to no compression even when subjected to the forces associated with pavement grinding. As shown in FIG. 8 the periphery of the tire 152 is non-round and the diameter varies in a continuous undulating repeated pattern. The pattern is sinusoidal and wraps around the periphery of the tire 152. The tire 152 forms three lobes 160 of maximum diameter. The lobes 160 alternate with depressions 162 of minimum diameter. The areas between the lobes and the depressions 162 gradually transition in the sinusoidal pattern. In the embodiment shown the diameter varies one quarter inch, between twelve and three-quarter inches at the depressions 162 and thirteen inches at the maximum height of the lobes 160. The distance between adjacent depressions 162 and also between the peaks of the lobes 160, is fourteen and one-half inches. As the depressions 162 and the lobes 160 are evenly spaced about the periphery of the tire 152, the distance between any two lobes 160 and the distance between any two depressions is the same fourteen and one-half inches.

As shown in FIG. 7, the control wheel 150 is supported on an axle 156 and hub 158. Moreover, the control wheel may include multiple tires 152, rims 154 and hubs 158 mounted in a side by side relationship along the axle 156. Therefore, the control wheel 150 provides increased lateral contact with the pavement and less variation due to minor flaws and defects in the pavement.

Figure 3:
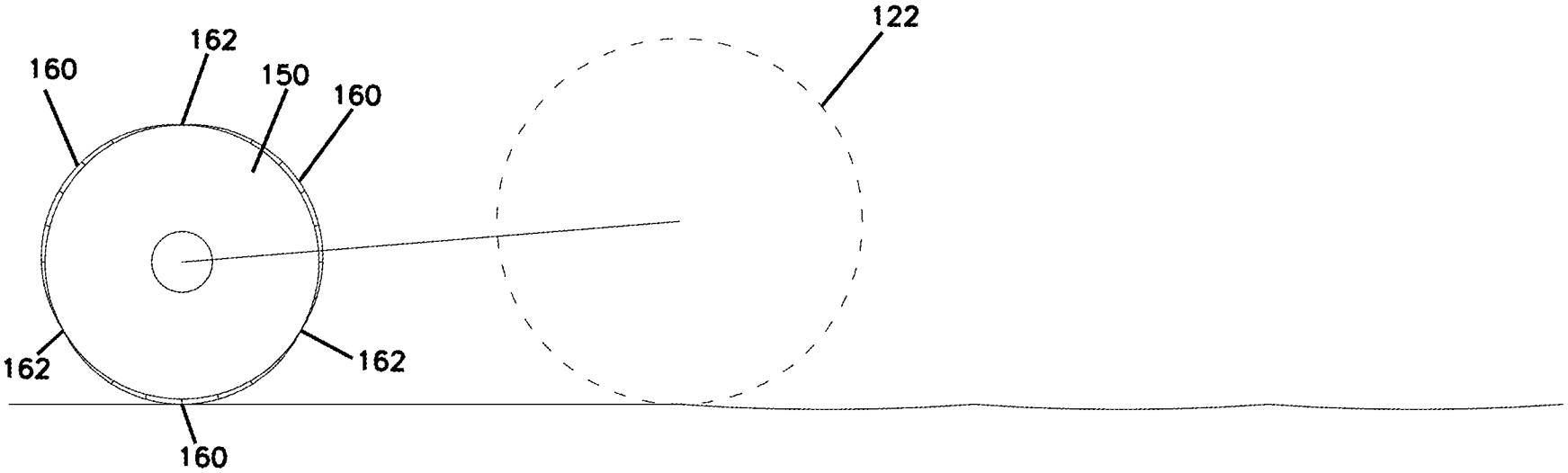
FIG. 3 is a side elevational view of a control wheel and grinding arbor in a first position for the pavement grinder shown in FIG. 1.
Figure 4:
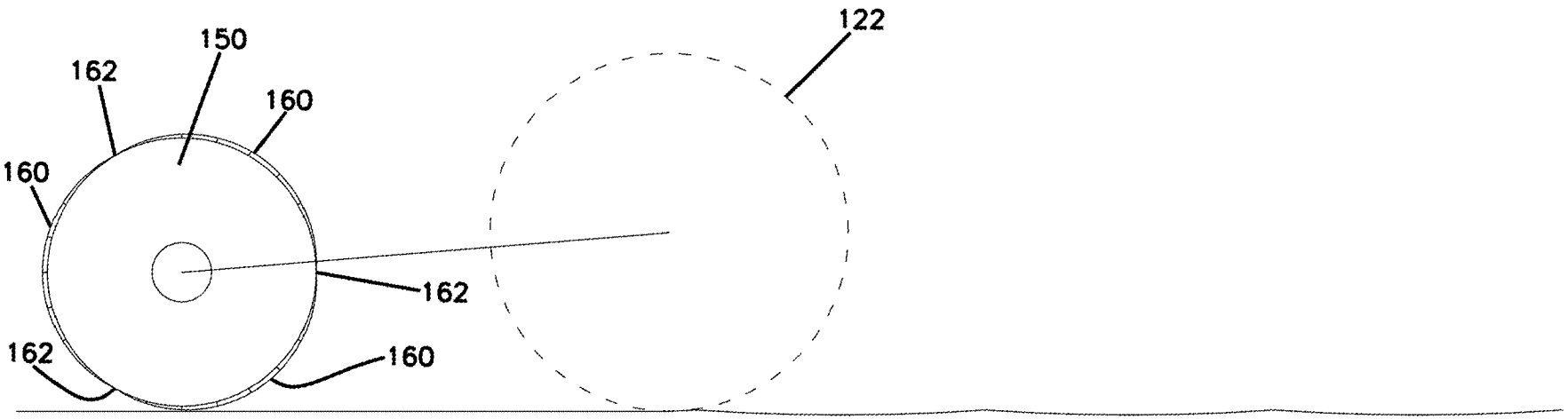
FIG. 4 is a side elevational view of a control wheel and grinding arbor in a second position.
Figure 5:
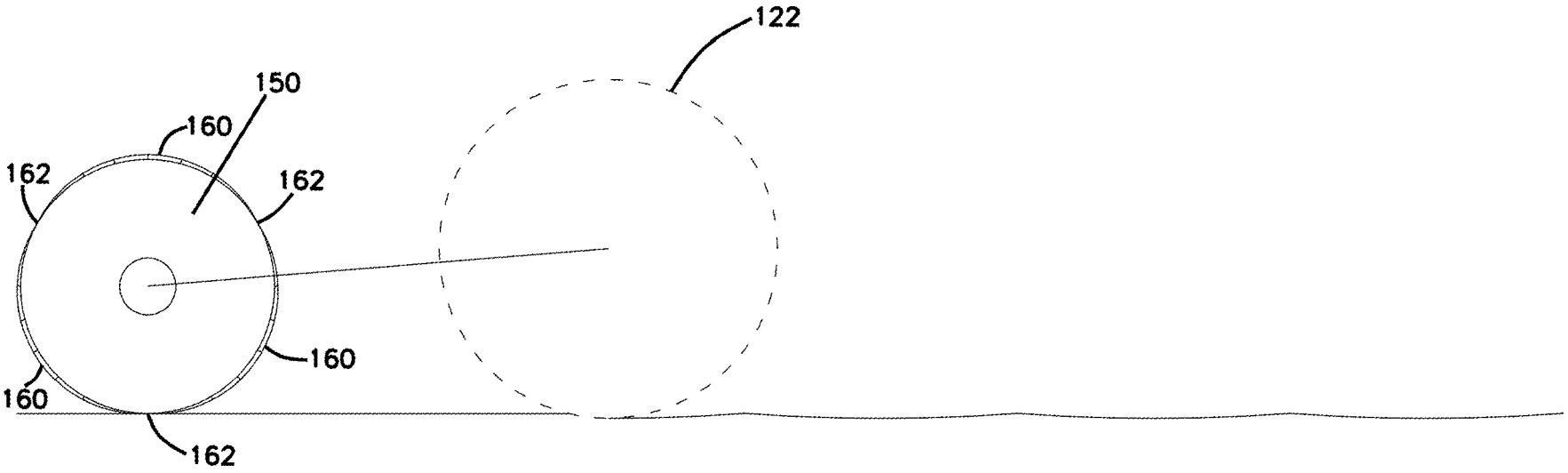
FIG. 5 is a side elevational view of a control wheel and grinding arbor in a third position.

Referring to FIGS. 3-5, the control wheel 150 controls the up and down movement of the cutting assembly and the depth with which the arbor 122 grinds the pavement. The control wheel has a non-circular outer periphery, as shown in FIG. 8. The diameter of the control wheel 150 increases and decreases gradually and continuously around the wheel in an evenly spaced pattern. In the embodiment shown, the control wheel 150 has three lobes 160 of increased diameter alternating with three depressions 162 of decreased diameter. The outer periphery gradually transitions from the depressions 162 to the lobes 160. The gradual increase and decrease follows a sinusoidal pattern extending around the periphery of the control wheel 150. The varying diameter causes the axle at the axis of rotation of the control wheel 150 to rise and fall. The control wheel axis of rotation is at a maximum elevation relative to the ground when one of lobes 160 is in contact with the ground surface while the axis of rotation is at its lowest elevation when one of the depressions 162 engages the ground. The height of the axis of rotation relative to the ground rises and falls as the control wheel 150 ground engagement point transitions between the maximum at the apex of the lobes 160 and the trough at the bottom of the depressions 162 on the control wheel surface.

Figure 10:
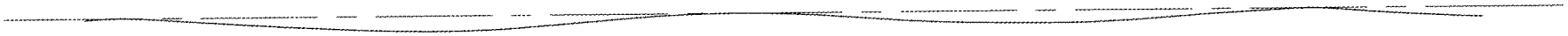
FIG. 10 is a side view of a sinusoidal profile of a sonic noise alert pattern made according to the principles of the present invention.

As the cutting assembly 120 is coupled to the control wheel 150, the height of the arbor rises and falls with the height of the axle of the control wheel 150, the arbor 122 also rises and falls in a sinusoidal pattern. The rising and falling causes the arbor to grind a sinusoidal pattern. Such a sonic noise alert pattern is shown in FIG. 10. It can be appreciated that the depth of the pattern can be varied by varying the relative position of the arbor relative to the control wheel 150. However, the depth may be set so that the arbor 122 does not grind when the lobes engage the ground. It can also be appreciated that the grinding is at its deepest when the depressions of the control wheel 150 engage the ground.

As shown in FIG. 3, when one of the lobes is engaging the ground, the arbor 122 is raised. As the grinder 100 advances and the control wheel 150 rolls along the ground, the control wheel 150 is supported on a portion of its periphery transitioning between the maximum diameter of a lobe and the bottom of a depression, as shown in FIG. 4. At this position, the arbor 122 is lower slightly to grind at a shallow depth in the pavement. Further advancement of the grinder and rotation of the control wheel 150 takes the cutting assembly 120 to the position shown in FIG. 5. In FIG. 5, one of the depressions of the control wheel 150 engages the ground and the grinding arbor 122 descends to its greatest depth into the pavement. This forms the bottom of a depression in the pavement of a sonic noise alert pattern. As the grinder advances further and the control wheel 150 continues to roll along the ground, the cutting assembly again attains the configuration of FIG. 4. Further advancement moves the control wheel 150 and arbor 122 to the configuration shown in FIG. 3. As the grinder 100 advances, the pattern repeats and an evenly spaced sinusoidal pattern is formed as shown in FIG. 10. The transitions between the pavement surface and the bottom of a depression formed in the pavement are gradual and the sinusoidal pattern formed is quieter when driven over by vehicle tires as compared to conventional sonic noise alert patterns.

It is to be understood, however, that even though numerous characteristics and advantages of the present invention have been set forth in the foregoing description, together with details of the structure and function of the invention, the disclosure is illustrative only, and the changes may be made in detail, especially in matters of shape, size and arrangement of parts within the principles of the invention to the full extent indicated by the broad general meaning of the terms in which the appended claims are expressed.

What is claimed is:

1. A pavement grinding apparatus moving over pavement, having a surface, along a direction of travel, comprising:

a cutting assembly comprising:

a grinding carriage; the grinding carriage including a rotating arbor having a plurality of cutting elements;

a control wheel in contact with the pavement and connected to the grinding carriage for maintaining the arbor in continuous contact with the pavement, the control wheel having a rotational axis and an outer periphery, wherein a first portion of the outer periphery is furthest from the rotational axis and a second portion of the outer periphery is closest to the rotational axis; wherein the first portion of the periphery of the control wheel has a radius of curvature at least as great as a radius of curvature of the second portion of the periphery of the control wheel;

a link connecting the control wheel to the grinding carriage to maintain a constant relative elevation between the rotating arbor and the control wheel and to impart a continuous cyclical up and down movement to the grinding carriage to increase and decrease a desired grinding depth of the arbor below the pavement surface through a plurality of revolutions of the control wheel.

2. A pavement grinding apparatus according to claim 1, the control wheel comprising a plurality of equally spaced apart lobes on a periphery of the control wheel.

3. A pavement grinding apparatus according to claim 2, wherein the control wheel comprises a plurality of sections of reduced radius alternating with the lobes on the periphery of the control wheel.

4. A pavement grinding apparatus according to claim 2, comprising a plurality of the control wheels mounted on an axle transverse to the direction of travel.

5. A pavement grinding apparatus according to claim 4, wherein the lobes of each of the plurality of the control wheels is laterally aligned.

6. A pavement grinding apparatus according to claim 1, wherein the control wheel is ahead of the arbor along the direction of travel.

7. A pavement grinding apparatus according to claim 1, wherein the cutting assembly is mounted to a truck chassis.

8. An apparatus according to claim 7, further comprising a first motor driving the truck chassis and a second motor driving the arbor.

9. A pavement grinding apparatus according to claim 1, wherein the cutting assembly is mounted to a truck chassis and extends rearward from the truck chassis.

10. An apparatus according to claim 1, wherein a radius of the control wheel increases and decreases to impart a substantially sinusoidal pattern in the pavement.

11. A pavement grinding apparatus according to claim 1, further comprising an adjustable profile cylinder coupled to the rotating arbor and configured to adjust the height of the rotating arbor relative to the control wheel by extending or contracting.

12. A pavement grinding apparatus moving over pavement, having a surface, along a direction of travel, comprising:

a cutting assembly comprising:

a grinding carriage; the grinding carriage including a rotating arbor having a plurality of cutting elements;

a control wheel in contact with the pavement and connected to the grinding carriage for maintaining the arbor in continuous contact with the pavement, the control wheel having a rotational axis and an outer periphery, wherein a first portion of the outer periphery is further from the rotational axis than a second portion of the outer periphery;

wherein the first portion of the outer periphery of the control wheel is at a furthest distance from the rotational axis of the control wheel and has a radius of curvature at least as great as a radius of curvature of the second portion of the periphery of the control wheel closer to the rotational axis of the control wheel.

13. A pavement grinding apparatus according to claim 12, the control wheel being connected to the grinding carriage to maintain a constant relative elevation between the rotating arbor and the control wheel and to impart a continuous cyclical up and down movement to the grinding carriage to increase and decrease a desired grinding depth of the arbor below the pavement surface.

14. A pavement grinding apparatus according to claim 12, wherein the first portion of the control wheel at a greatest distance from a rotational axis of the control wheel comprises an arcing outer periphery and is opposite the second portion of the control wheel at minimum distance from the rotational axis of the control wheel.

15. A pavement grinding apparatus according to claim 12, wherein the second portion of the outer periphery of the control wheel comprises a portion of the control wheel closest to the rotational axis.

16. A method for forming reduced volume rumble strips into a surface of pavement, the method comprising:

providing a chassis and a cutting assembly attached to the chassis, the cutting assembly comprising:

a grinding carriage; the grinding carriage including a rotating arbor having a plurality of cutting elements configured to cut the pavement;

a control wheel in contact with the pavement and connected to the grinding carriage for maintaining the arbor in continuous contact with the pavement, the control wheel having a rotational axis and an outer periphery, wherein a first portion of the outer periphery is further from the rotational axis than a second portion of the outer periphery;

wherein the first portion of the outer periphery of the control wheel is at a furthest distance from the rotational axis of the control wheel and has a radius of curvature at least as great as a radius of curvature of the second portion of the periphery of the control wheel closer to the rotational axis of the control wheel;

contacting the surface of the pavement with the control wheel;

rotating the control wheel along a direction of travel across the surface of the pavement and translating the chassis along the pavement, wherein the control wheel imparts a continuous up and down movement to the grinding carriage and the plurality of cutting elements relative to the surface of the pavement;

wherein the continuous up and down movement of the grinding carriage cycles the grinding carriage through a plurality of peak positions and trough positions to impart a continuous cut of varying depth below the surface of the pavement through a plurality of revolutions of the control wheel, the peak positions comprising at least one of the plurality of cutting elements being at least partially below the surface of the pavement and the trough positions comprising at least one of the plurality of cutting elements being below the peak positions.

17. A method according to claim 16, the method further comprising extending or retracting an adjustable profile cylinder to change the height of the arbor relative to the control wheel.

18. A method according to claim 16, wherein the continuous up and down movement of the grinding carriage cycles the grinding carriage through a plurality of peak positions and trough positions to impart a continuous substantially sinusoidal cut of varying depth below the surface of the pavement through a plurality of revolutions of the control wheel.

* * * * *